United States Patent [19]

Rattin et al.

[11] 4,129,378

[45] Dec. 12, 1978

[54] ELECTROPHOTOGRAPHIC COPYING MACHINE HAVING A MASKING DEVICE FOR DIFFERENT COPY SHEET FORMATS

[75] Inventors: Luciano Rattin, Ivrea (Turin); Roberto Guelfo, Montanaro (Turin), both of Italy

[73] Assignee: Ing. C. Olivetti & C., S.p.A., Ivrea, Italy

[21] Appl. No.: 757,537

[22] Filed: Jan. 7, 1977

[30] Foreign Application Priority Data

Jan. 20, 1976 [IT] Italy ..... 67123 A/76

[51] Int. Cl.[2] ..... G03G 15/00

[52] U.S. Cl. ..... 355/14; 355/7

[58] Field of Search ..... 355/7, 3 R, 11, 8, 14

[56] References Cited

U.S. PATENT DOCUMENTS 3,751,155 8/1973 Liechty ..... 355/3

OTHER PUBLICATIONS

"Shutter Assembly for Selectively Erasing Nonimage Areas of a Photoconductor Segment," IBM Tech. Bull. vol. 16, No. 4, Sep. 1973, pp. 1262–1263.

*Primary Examiner*—R. L. Moses

*Attorney, Agent, or Firm*—W. R. Hulbert

[57] ABSTRACT

Electrophotographic copying machine comprising a discharge device for discharging the area of the movable photoconductive element which exceeds the area of the copy-sheet residing in the machine. The discharge device comprises a lamp and a mask interposed between the lamp and the photoconductive surface, the mask has a plurality of slots, each slot being associated to a copy-sheet format; each slot comprises a first portion for discharging the margin zones of the photoconductive element, which zones has a length equal to the difference between the width of the photoconductive element and a dimension of the copy-sheet format selected; and a second portion for discharging the entire width of the photoconductive element, the second portion is positioned in front of the lamp after that a length of the photoconductive element equal to the other dimension of the format has been moved in front of the discharge device.

5 Claims, 7 Drawing Figures

ELECTROPHOTOGRAPHIC COPYING MACHINE HAVING A MASKING DEVICE FOR DIFFERENT COPY SHEET FORMATS

BACKGROUND OF THE INVENTION

The present invention relates to an electrophotographic copying machine.

As is known in copying machines of the aforesaid type, a photoconductive layer in the form of a sheet wrapped around, or of a coating deposited on, a drum or other cyclically movable part is sequentially carried through charging, exposing, developing, transfer and cleaning stations disposed adjacent the path of this movable part.

Copying machines of the aforesaid type are known which are capable of supplying copies on sheets of different formats and therefore of photocopying originals having different formats. In this case, both the lateral dimension and the longitudinal dimension of the photoconductive sheet or coating will obviously have to be at least equal to the maximum lateral and longitudinal dimensions of the copy sheets.

A first disadvantage of these types of machines may arise when it is intended to photocopy parts only of originals having a format exceeding that of the copy sheets present for the time being in the machine. In this case, during stage 4, only part of the image of the original is transferred in the form of particles of colour to the copy sheet, while the particles of colour constituting that part of the image on the photoconductive surface which exceeds the format of the copy sheet are removed during the cleaning stage.

The disadvantage consists in the fact that, if the aforesaid procedure is prolonged for many copying cycles a useless consumption of developing powder or liquid occurs for rendering visible on the photoconductive layer that part of the image of the original which exceeds the format of the copy sheet used; moreover, the cleaning device becomes overloaded, since the particles of colour to be removed are much more than those which normally remain on the photoconductive layer when the transfer of the image to the copy sheet is complete. Finally, in the case in which developing powder is used, the amount of powder circulating unduly through the machine is greatly increased, with all the drawbacks deriving from the presence of powder in the various devices of the machine.

SUMMARY OF THE INVENTION

An object of the present invention is therefore that of providing a copy machine of the electrostatic type in which the above mentioned disadvantages are avoided.

According to the present invention there is provided an electrophotographic copying machine, wherein a photoconductive layer is conveyed cyclically through a series of stations including a station for charging its surface electrostatically, a station for exposing the surface to the light image of the original to be copied, and a station for developing the image to be transferred to a copy sheet of predetermined format having an area smaller than the area of the photoconductive layer, the machine comprising a device disposed in the path of the photoconductive layer between the exposure station and the developing station for discharging that portion of the area of the photoconductive layer which exceeds the area of the copy sheet.

BRIEF DESCRIPTION OF THE DRAWINGS

The invention will be described in more detail, by way of example, with reference to the accompanying drawings, wherein.

DESCRIPTION OF THE PREFERRED EMBODIMENT

Figure 1:
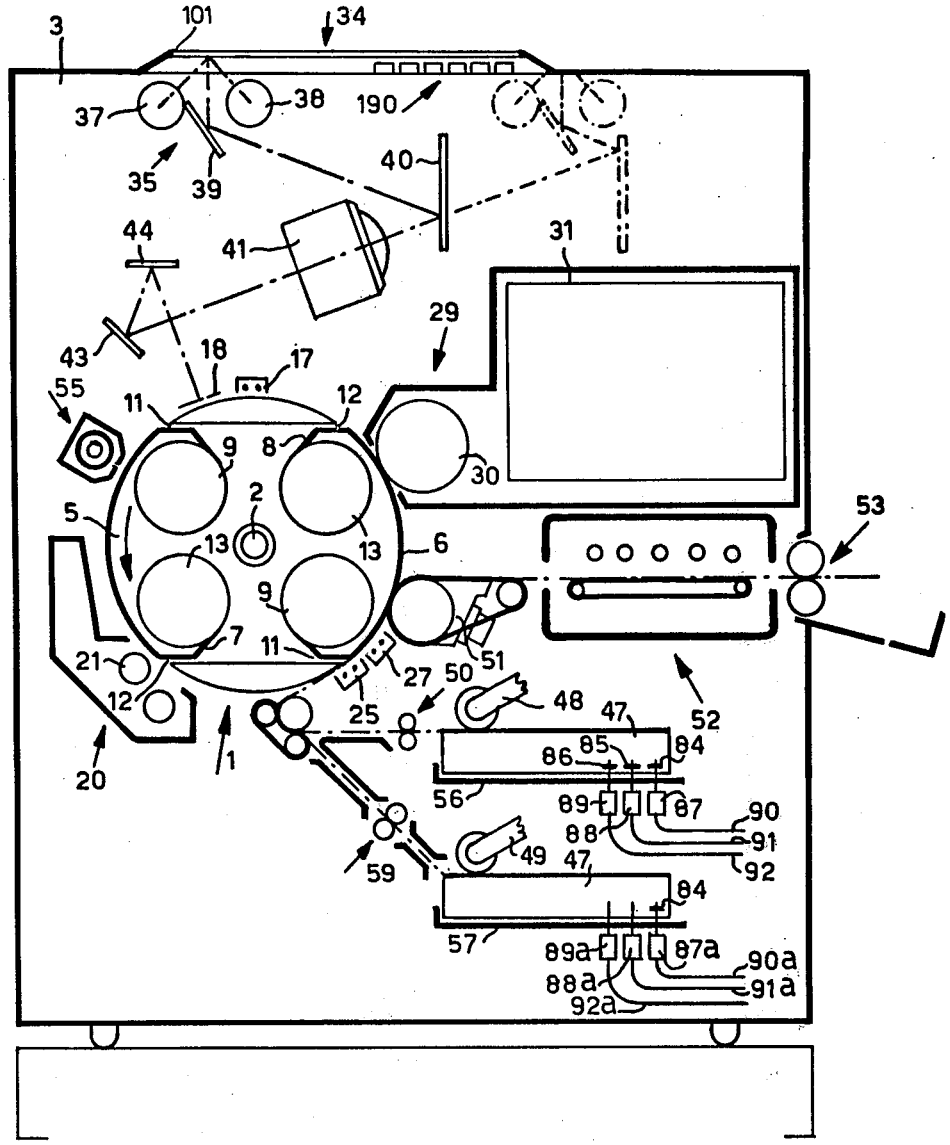
FIG. 1 is a front view of an electrophotographic copying machine embodying the invention.

Referring to FIG. 1, the copying machine embodying the invention comprises an electrophotographic drum 1 journalled by means of a hub 2 in the frame 3 of the machine. Around the periphery of the drum 1 and adjacent thereto there are arranged various devices constituting the stations typical of the electrophotographic copying process.

There are: a corona-effect charging station 17, an exposure station 18, a developing station 20 comprising a magnetic developing brush 21, a transfer station comprising a transfer corona charger 25, a copy sheet detachment station comprising an alternating-current corona charger 27, and a cleaning station 29 for the photosensitive band or belt on the drum, comprising a rotating brush 30 and an aspirator and filter 31.

The drum 1 is of the type described in U.S. Patent Application Ser. No. 730,565 filed on Oct. 7, 1976 and comprises two diametrically opposite sectors 5 and 6 around which there are wrapped or wound portions of two belts 7 and 8 of photoconductive material fed from respective feed reels 9 mounted inside the drum 1 and emerging onto the outer surface of the drum through slots 11 and re-entering the interior of the drum 1 through slots 12 to be wound on take-up reels 13 also mounted inside the drum 1.

Figure 6:
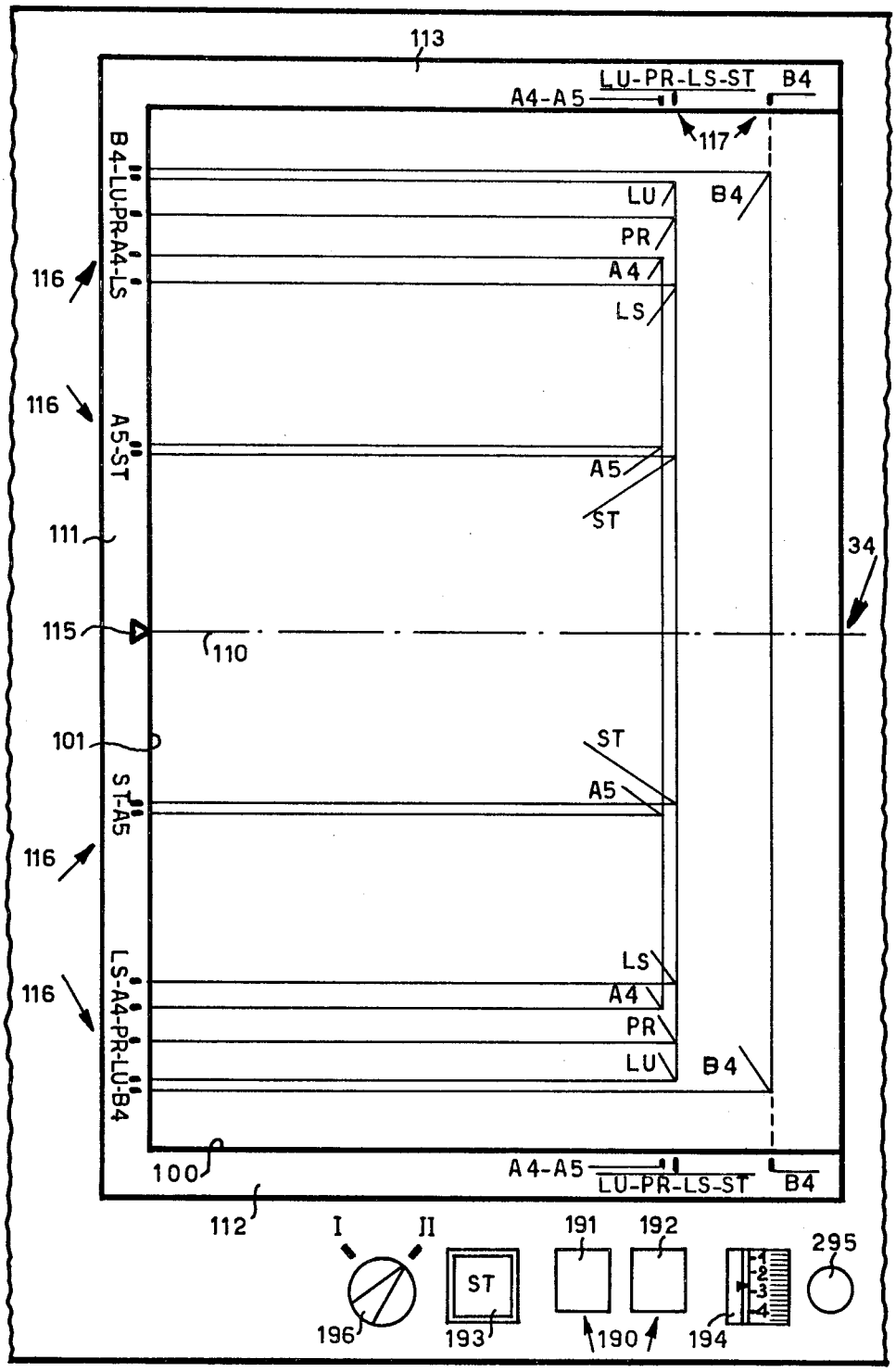
FIG. 6 is a plan view of the illuminating surface of the machine of FIG. 1.

The copying machine of FIG. 1 moreover comprises a plane illuminating surface 34 for the originals to be reproduced, which is shown in detail in FIG. 6 and an optical and illuminating system 35 comprising two lamps 37 and 38 and a first system of mirrors 39 and 40 movable, in synchronism with the rotation of the drum 1, parallel to the illuminating surface 34 for effecting the scanning of successive portions of the original placed on the surface 34. A fixed lens 41 and second system of mirrors 43 and 44 transmit a natural size image of successive portions of the original placed on the surface 34, which are obtained by scanning, onto successive portions of the photoconductive belts at the exposure station 18. Two boxes or cassettes 47 contain stacks of copy sheets of two different formats and are positioned removably on supports 56 and 57. Two devices 48 and 49 can be activated selectively to feed these sheets one by one from one of the cassettes 47 through conveying systems 50 and 59, respectively, to the transfer station 25. A third conveying system 51 conveys the sheet after the image transfer to a unit 52 for fixing the toner on the copy sheet, and a fourth conveyor 53 following the fixing unit ejects sheets from the machine.

A unit 55 for discharging the portions of the area of the photoconductive belts 7 and 8 which exceed both laterally and longitudinally the format of the copy sheets present in the machine in the cassettes 47 is disposed adjacent the periphery of the drum between the exposure station 18 and the developing station 20.

The scanning movement of the optical system 35 is linked with the rotation of the drum 1 in such manner that for each complete revolution of the drum two scanning runs of the optical system are obtained, so that both the belts are exposed during each complete revolution of the drum. During the printing of multiple copies of the same original, two copies of this original are made for each revolution of the drum 1.

Figure 2:
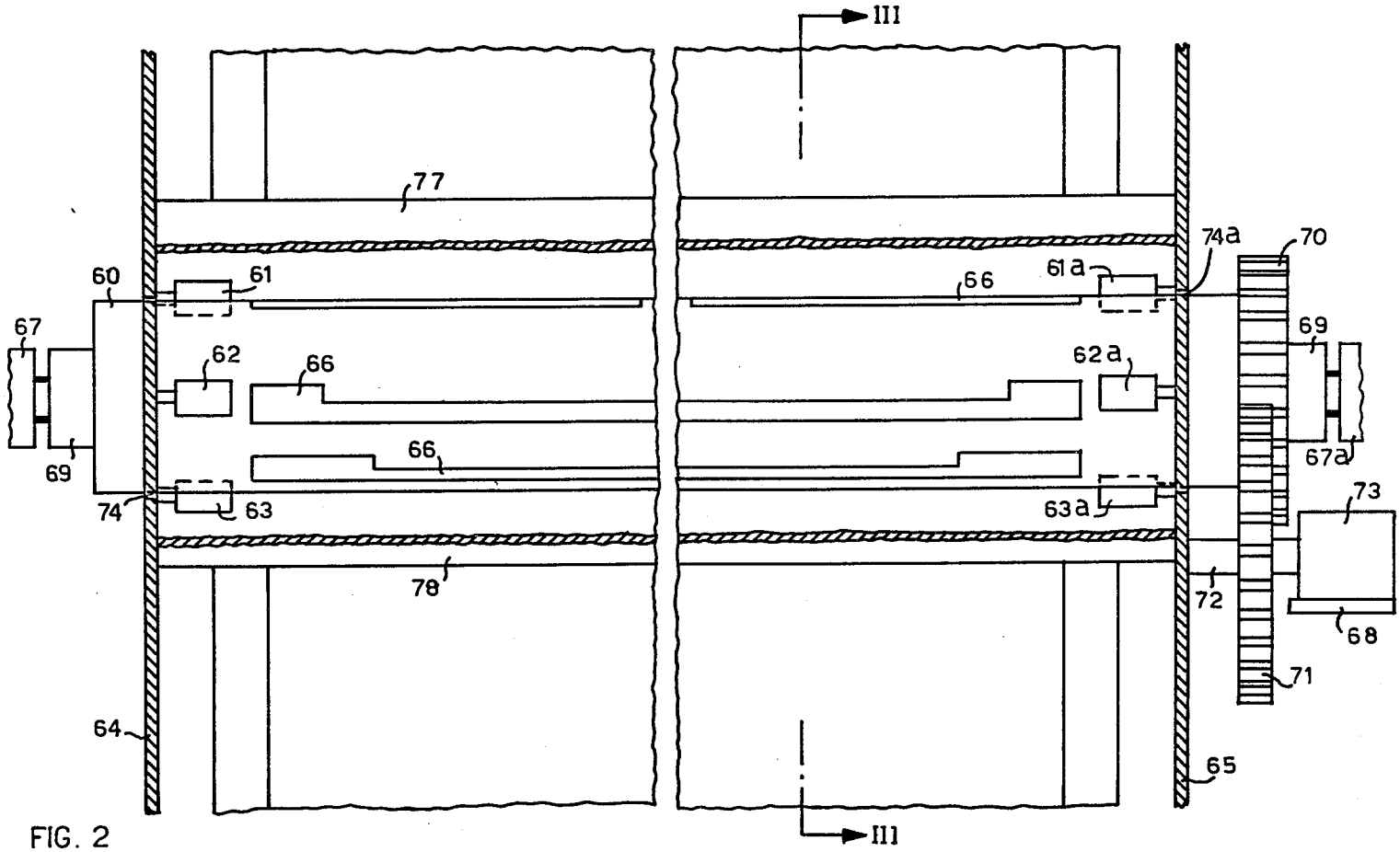
FIG. 2 is a side view of a discharging device included in the copier of FIG. 1.
Figure 3:
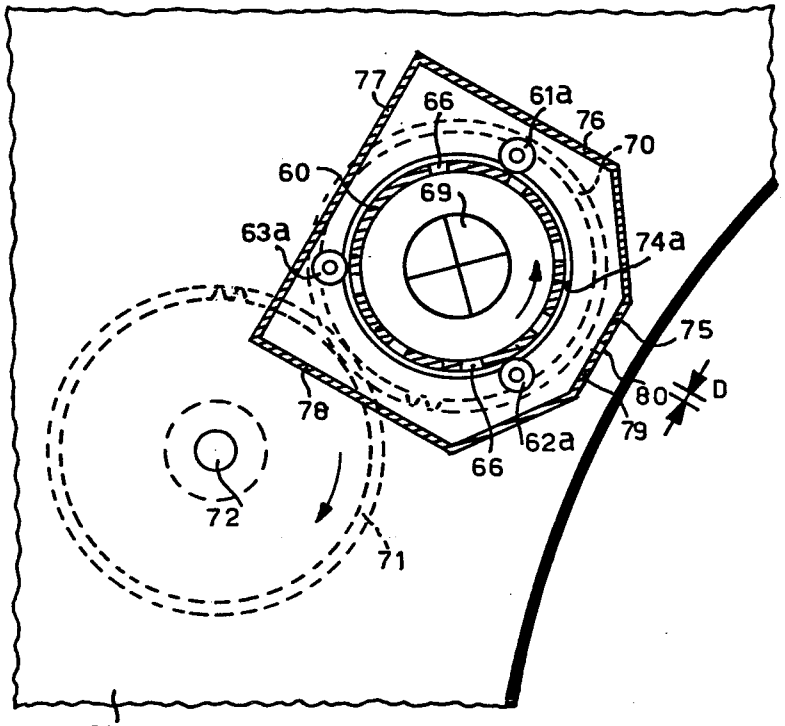
FIG. 3 is a section on the line III—III of FIG. 2.

FIGS. 2 and 3 show in greater detail the structure of the discharging unit 55. This comprises a hollow cylinder 60 of opaque material extending over the entire length of the drum 1 and supported at its ends, so as to be rotatable about its own axis, by three rollers 61, 62, 63 and 61*a*, 62*a*, and 63*a* mounted rotatably in the side walls 64 and 65, respectively, of the body of the machine.

The cylinder extends through holes 74 and 74*a* in the side walls 64 and 65, respectively. The hollow cylinder 60 has spaced regularly over its surface a series of longitudinal slots 66 centred with respect to its opposite ends and to the median section of the drum 1. The slots 66 extend completely through the thickness of the cylinder so as to form windows therethrough. Inside the hollow cylinder and coaxial therewith there is mounted a halogen lamp 69 having a tube extending throughout the length of the cylinder and fixed at its opposite ends in lampholders 67 and 67*a* fast with the body 3 of the machine.

A ring gear 70 is fixed at one end of the hollow cylinder 60 and coaxially therewith. The ring gear 70 meshes with a gear 71 keyed on the shaft 72 of a bidirectional stepping motor 73 supported by a support part 68 of the machine.

A series of walls 75, 76, 77, 78, 79 (FIG. 3) supported between the side walls 64 and 65 is placed all around the cylinder 60 to define a screen casing for this cylinder. The walls 75 to 79 have their surface facing the cylinder black in colour and treated so as to absorb almost completely the light of the halogen lamp 69 issuing through the slots 66 of the cylinder 60.

The walls 75 and 79 define adjacent the cylinder 1 a slot 80 extending over the entire width of the cylinder 1. The width D of the slot 80 is smaller than, or equal to, the width of the slots 66 in the hollow cylinder 60. Through the slot 66 aligned with the slot 80 and the slot 80 itself, the light coming from the lamp 69, collimated by the slots 66 and 80, can therefore reach the photoconductive belt 7 or 8 located on the drum 1, discharging in this way a longitudinal strip of photoconductor 7 or 8 equal to the longitudinal extent of the slots 66 of the cylinder 60, as will be better described hereinafter.

As already stated, the machine is able to handle copy sheets of different formats. Purely by way of example, it is assumed that the machine is able to operate with the seven formats indicated in Table 1 together with their longitudinal and lateral dimensions.

Table 1

| Format | Longitudinal Dimension mm. | Transverse Dimension mm. | Code 92/92a | 91/91a | 90/90a |
|---|---|---|---|---|---|
| UNI A4 | 297 | 210 | 0 | 0 | 1 |
| LETTER SIZE (LS) | 279.4 | 216 | 0 | 1 | 0 |
| LEGAL USA (LU) | 355 | 216 | 0 | 1 | 1 |
| US FOOLSCAP (PR) | 330 | 216 | 1 | 0 | 0 |
| B4 | 364 | 257 | 1 | 0 | 1 |
| A5 | 148 | 210 | 1 | 1 | 0 |
| STATEMENT (ST) | 140 | 216 | 1 | 1 | 1 |

With each format there is associated a cassette 47 in which the stacks of sheets of the format must be contained, the cassette having margin stops adapted only for stacks of that format.

Beside each cassette support 56 and 57 there are mounted three microswitches 87, 88, 89 and 87*a*, 88*a* and 89*a*, respectively (FIG. 1), to which wires 90, 91 and 92 and 90*a*, 91*a* and 92*a* are connected. Each of the seven cassettes 47 can bear at its side in predetermined positions at least one and up to three lugs 84, 85, 86. These lugs operate the microswitches.

The cassettes 47 are positioned in the machine on the cassette supports 56 and 57 so that the copy sheets contained in them are centred with respect to the median section of the drum 1. When a cassette is positioned in the machine on one of the two supports 56 and 57, each of the lugs 84, 85, 86 (if present) of that cassette is adapted to close the corresponding microswitch 87, 88, 89 and 87*a*, 88*a*, 89*a*, respectively.

From the logical point of view, the closing of one of the microswitches, for example 87, and therefore the presence of the lug 84, is equivalent to putting a logical 1 level on the corresponding wire 90, while the absence of the lug 84 is equivalent to having the logical 0 level on the same wire 90.

Therefore, there is present on the three wires 90, 91, 92 or 90*a*, 91*a*, 92*a*, with a cassette inserted on the supports 56 and 57, respectively, a 3-bit binary code which enables seven different cassettes to be identified, the configuration 000 (logical zero on all three wires) being reserved for encoding the absence of an inserted cassette in the machine. In Table 1, beside each format, there is also given the corresponding binary code present on the three wires 90 to 92 and 90*a* to 92*a* and identifying that format. The machine is therefore shown in FIG. 1 with the cassette 47 of the STATEMENT format on the support 56 and the cassette 47 of the UNI A4 format on the support 57.

FIG. 6 shows, as seen from above, the plane illuminating surface 34 of the machine, which is substantially a rectangular glass plate having sides 100 and 101. The side 101 can also be seen in FIG. 1. The length of the side 101 is substantially equal to the width of the drum 1, while the length of the sides 100 is at least equal to, or greater than, the circumferential arc covered by the belt 7 or 8 on the drum 1.

Like the copy sheets, the originals must also be positioned on the illuminating surface in a centred position with respect to the median section of the drum 1, which corresponds to the middle of the illuminating surface indicated by the axis 110. For the purpose of facilitating positioning of the originals, three scales 111, 112 and 113 are disposed on the side 101 and on the two sides 100.

The scale 111 has a notch 115 indicating the middle of the illuminating surface and, on opposite sides with respect to the notch 115, a series of notches or nicks 116 indicating the position of the longitudinal ends of the various formats to be correctly positioned on the illuminating surface 34.

Thus, two corresponding series of notches or nicks 117 are also marked on the two scales 112 and 113 and the straight line passing through a notch of the scale 112 and through the corresponding notch of the scale 113 defines the straight line on which lies the rear edge of the sheet of a given format when correctly positioned on the illuminating surface.

In FIG. 6 there is moreover outlined the correct position of the original sheets having formats corresponding to those of Table 1 when correctly positioned on the illuminating surface.

The original sheet is therefore centred with respect to the notch 115 and with one side defining the longitudinal dimension aligned with, and placed above, the edge 100 of the illuminating surface and therefore in contact with the straight edge 111.

Figure 4:
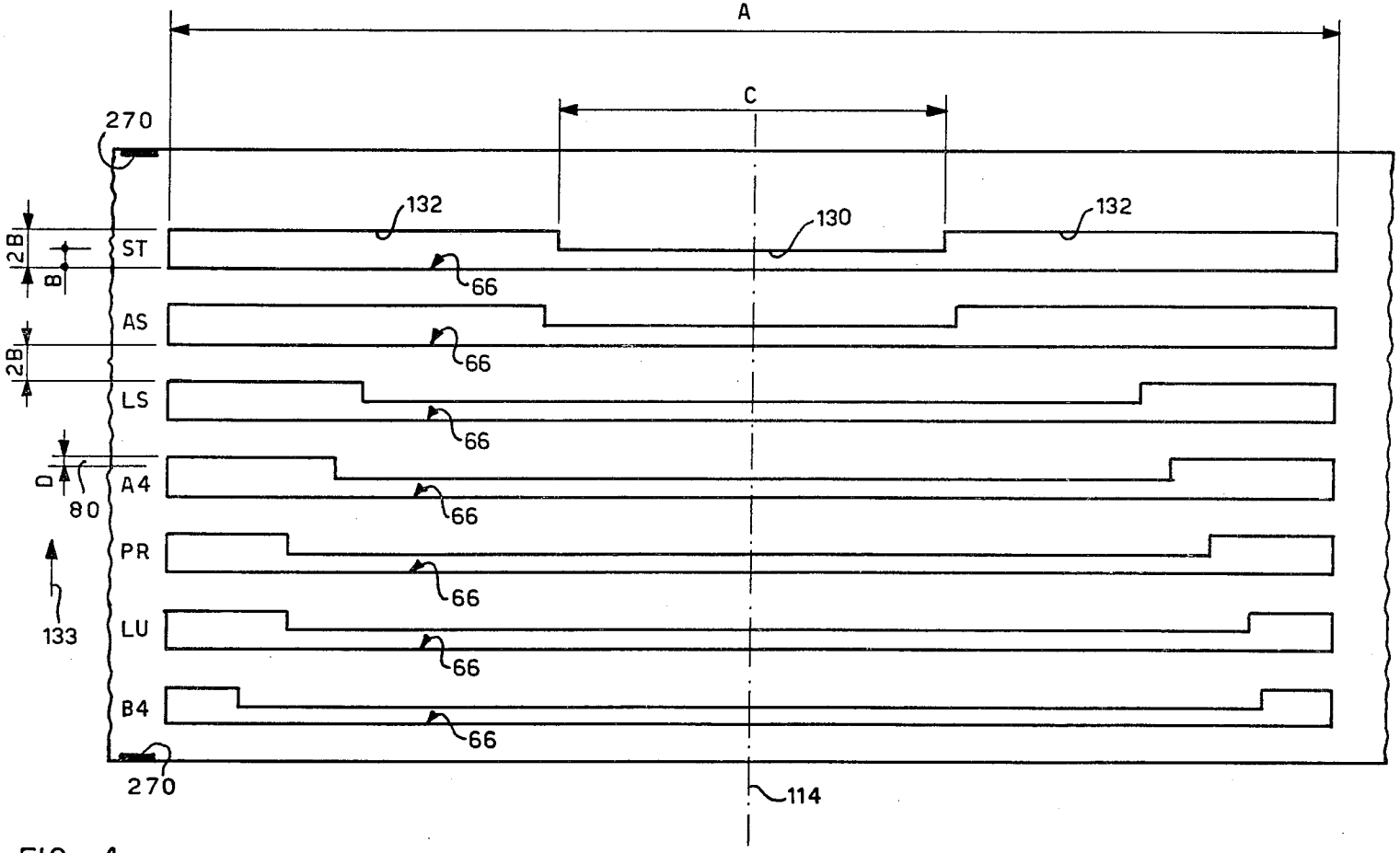
FIG. 4 is a development in a plane of the periphery of a hollow cylinder included in the device of FIG. 2.

FIG. 4 shows the development of the cylindrical surface of the hollow cylinder 60 in a plane. Each slot 66 is centred with respect to the median line 114 of the cylinder 60 which, as already stated, coincides with that of the drum 1.

The longitudinal extent A of each slot is equal to the width of the photoconductive belts 7 and 8. Each slot 66 is associated with a given format of copy sheet of Table 1 and comprises a central portion 130 of given width B and two equal terminal portions 132 of width 2B.

The length C of each central portion 130 is equal to the longitudinal dimension of the format of Table 1 with which the slot is associated.

For purposes of illustration, at the side of each slot in FIG. 4 there is written the abbreviation or symbol of the format to which it relates. Also for purposes of illustration, there is shown in FIG. 4, by short lines, the relative position and the thickness of the above-described slot 80. It should be noted that the width D of the slot 80 is smaller than the width B of the central portion 130 of each slot 66.

As already described, the hollow cylinder 60 is rotated through coupling of the ring gear 70 with the gear 71 by the stepping motor 73. The transmission ratio of this coupling action is such that to the rotation of the motor in a given direction by one step there corresponds a rotation of the cylinder 60 in the opposite direction equal to an arc of amplitude B. Therefore, assuming that the terminal portions 132 of the slot 66 corresponding to the format A4 are positioned in front of the slot 80, as in FIG. 4, the light of the lamp 69 passes only through these terminal portions 132, discharging the photoconductive belt 7 or 8 at the margins, while the rotation of the motor 73 by one step in such manner as to advance the slot 66 of the format A4 in the direction of the arrow 133 also brings the central portion 130 of the slot 66 in front of the slot 80, whereby the entire width of the belt 7 or 8 is discharged.

Figure 5:
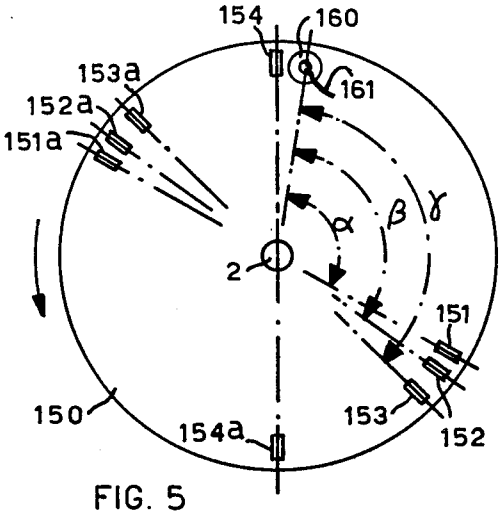
FIG. 5 is a front view of a strobe disc and a device for detecting the notches of the disc, which is used in the machine of FIG. 1.

On the shaft 2 of the drum 1 there is keyed a strobe disc 150 (FIG. 5). The strobe disc bears two series of diametrically opposed notches 151 and 151*a*, 152 and 152*a*, 153 and 153*a* and 154 and 154*a*. The notches are detected during the rotation of the drum 1 by a photocell reading device 160 of known type which sends an electric signal on the wire 161 for each notch detected.

When the drum 1 is stationary in the position of FIG. 1, the strobe disc is in the position of FIG. 5. The angle of rotation $\alpha$ that the disc and the drum must carry out before the notch 151 is detected by the device 160 corresponds to the passage in front of the slot 80 of a length of photoconductive belt 7 from the slot 12 equal to 210 mm, that is to the transverse dimension of the copy sheet formats A4 and A5 of Table 1. Thus, likewise the angle $\beta$ of the notch 152 corresponds to the passage in front of the slot 80 of 216 mm of belt 7, that is a length equal to the transverse dimension of the formats LS, LU, PR, ST of Table 1. Finally, the angle $\gamma$ corresponds to the passage in front of the slot 80 of 257 mm, that is a length equal to the transverse dimension of the format B4.

Similarly, the notches 151*a*, 152*a* and 153*a* pass in front of the reading device after, the rotation of the drum continuing, 210, 216 and 257 mm, respectively, of photoconductive belt 8, these lengths being measured from the slot 12, have passed in front of the slot 80. The notches 154 and 154*a*, on the other hand, signal each half revolution of the drum.

The copying machine is moreover provided with a control keyboard 190 (FIGS. 1, 6) comprising a switch-on key 191 for the machine, a key 192 for starting execution of a printing of copies, a setting dial 194 for the number of copies to be made, a signal lamp 295 which, when lit, signals that the copying machine is carrying out a printing of copies, a selector 196 adapted to select from the two cassettes 47 present in the machine the cassette from which the copy sheets are to be taken, and a visual display device 193 for the format of sheets which is currently present in the machine and selected.

Figure 7:
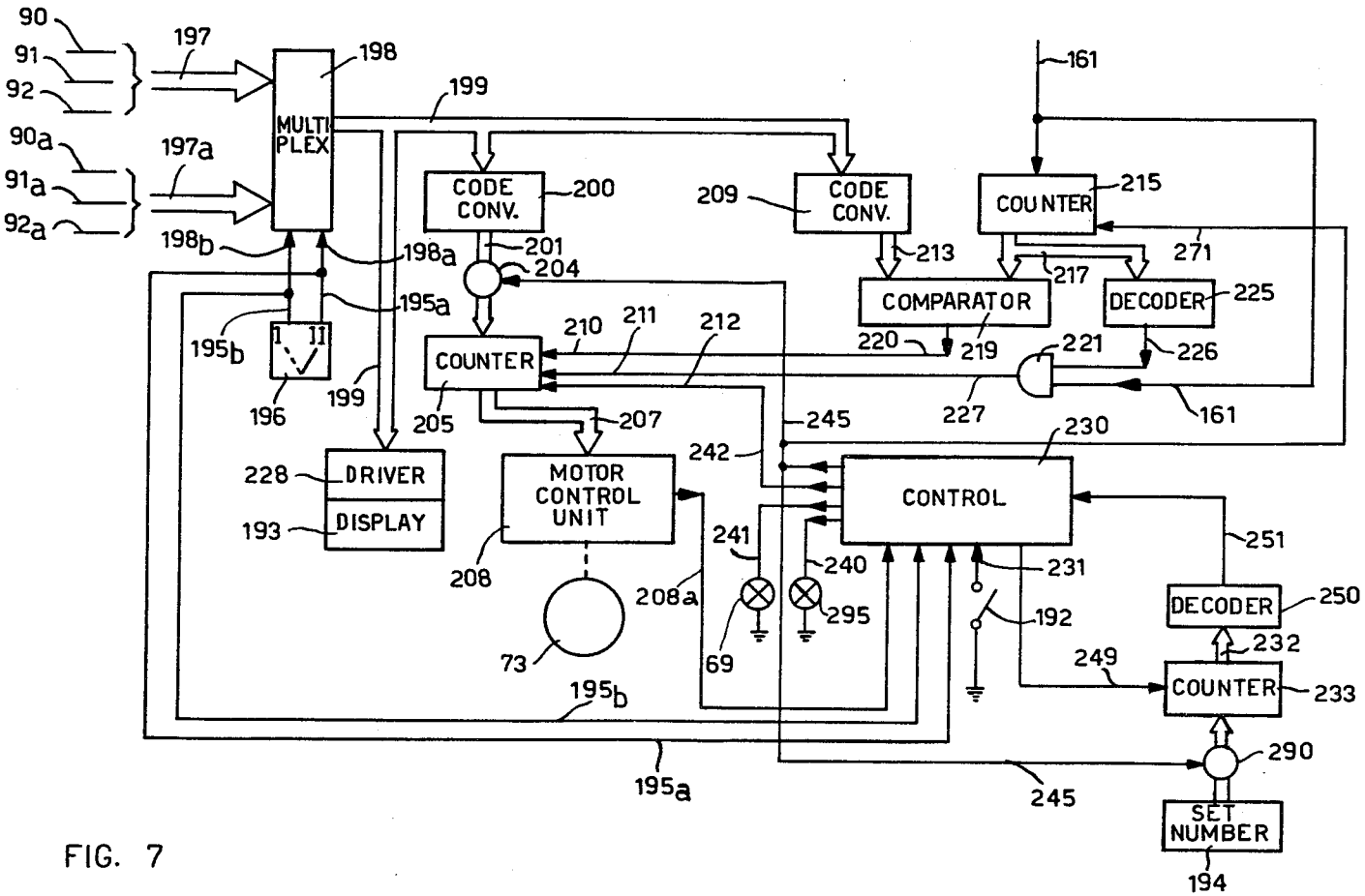
FIG. 7 is a control logic circuit for the device of FIG. 2.

FIG. 7 shows the control circuit of the copying machine. The three wires 90, 91 and 92 and 90*a*, 91*a* and 92*a* coming from the microswitches 87, 88 and 89 and 87*a*, 88*a* and 89*a* are regarded as 3-bit input channels 197 and 197*a*, respectively, to a multiplexer 198 having a three-bit output channel 199. The multiplexer 198 also has two control inputs 198*a* and 198*b* connected to wires 195*a* and 195*b*, respectively, leaving the selector 196. When the selector 196 is in its position indicated by the reference I in FIG. 6, it forces a logical 1 level on the input 198*b* and this conditions the multiplexer to put on the output channel 199 the code present on the input channel 197 and, conversely, when the selector is in the position indicated by the reference II in FIG. 6, it puts a logical 1 level on the input 198*a* and this conditions the multiplexer to put on the channel 199 the codes present on the channel 197*a*. The output 199 of the multiplexer 198 is moreover connected as input to a driving device 228 of known type for the visual display 193.

The output channel 199 is arranged as input to a code converter 200 adapted to supply as output on a 5-bit channel 201 a binary code in accordance with the code conversion of the following Table 2.

Table 2

| INPUT CODE | | | OUTPUT CODE | | | | |
|---|---|---|---|---|---|---|---|
| $2^2$ | $2^1$ | $2^0$ | $2^4$ | $2^3$ | $2^2$ | $2^1$ | $2^0$ |
| 0 | 0 | 1 | 1 | 0 | 0 | 0 | 0 |
| 0 | 1 | 0 | 0 | 1 | 1 | 0 | 0 |
| 0 | 1 | 1 | 1 | 1 | 0 | 0 | 0 |
| 1 | 0 | 0 | 1 | 0 | 1 | 0 | 0 |
| 1 | 0 | 1 | 1 | 1 | 1 | 0 | 0 |
| 1 | 1 | 0 | 0 | 1 | 0 | 0 | 0 |

Table 2-continued

| INPUT CODE | | | OUTPUT CODE | | | | |
|---|---|---|---|---|---|---|---|
| $2^2$ | $2^1$ | $2^0$ | $2^4$ | $2^3$ | $2^2$ | $2^1$ | $2^0$ |
| 1 | 1 | 1 | 0 | 0 | 1 | 0 | 0 |

The binary output code represents the number of steps that the stepping motor and, therefore, the cylinder 60 must perform from a fixed reference position represented in this code by the configuration 0 0 0 0 0 and corresponding to the position in which a notch 270 marked on the cylinder 60 (FIG. 4) is in front of the slot 80, by rotating in the direction of rotation indicated by the arrow in FIGS. 3 and 4, in order to position the lateral portions of the slot 66 corresponding to the format code present on the wires 90, 91 and 92 in front of the slot 80. The output code from the code converter 200 may therefore be regarded as representing the address of the slot 66.

The channel 201 is connected as input, through an AND gate 204, to a 5-bit counter 205. The counter 205 moreover has control inputs 210, 211, 212. A signal at logical 1 level applied to the input 210 of the counter 205 produces incrementing of the address stored in the counter 205 by one unit, and a signal at logical level 1 applied to the input 211 produces decrementing of the address stored in the counter 205 by one unit. A signal at logical 1 level applied to the input 212 of the counter forces into the counter the bit configuration 0 0 0 0 0 corresponding to the address of the fixed reference position of the motor and therefore also of the cylinder 60.

The output 207 of the counter 205 is connected as input to a control and bidirectional driving unit 208 of the stepping motor adapted to cause the stepping motor 73 to rotate in one direction or the other by way of the smaller number of steps from the position it is in to that specified by the 5-bit code in the aforesaid manner, which code is present as input via the channel 207.

The unit 208 is adapted to supply a logical 1 level as output on a wire **208*a*** when the said position present as input has been reached.

The channel 199 is also connected as input to a code converter 209 having a two-bit output channel 213. The code converter 209 is adapted to convert the three-bit binary code of the format selected by means of the selector 196, which is present as input, into a two-bit code in accordance with the following conversion table.

Table 3

| INPUT CODE | | | OUTPUT CODE | |
|---|---|---|---|---|
| 0 | 0 | 0 | 0 | 0 |
| 0 | 0 | 1 | 0 | 1 |
| 0 | 1 | 0 | 1 | 0 |
| 0 | 1 | 1 | 1 | 0 |
| 1 | 0 | 0 | 1 | 0 |
| 1 | 0 | 1 | 1 | 1 |
| 1 | 1 | 0 | 0 | 1 |
| 1 | 1 | 1 | 1 | 0 |

The output code represents in binary a serial number from 1 to 4, each of which is associated with a notch of the disc 150 in accordance with the following rules:

(1) 01 notches 151 and **151*a***
(2) 10 notches 152 and **152*a***
(3) 11 notches 153 and **153*a***
(4) 00 notches 154 and **154*a***

It will therefore be understood that this rule derives from counting the notches, starting from the notch 151 or **151*a*, with modulo 4**, in the order in which they present themselves in front of the reading device because of the rotation of the disc.

The wire 161 of the reading device 160 is connected to the count input of a two-bit binary counter 215, that is a counter having four as its maximum counting capacity. When the counter 215, which is of known type, exceeds the maximum counting capacity (corresponding to the configuration 11 of its output), it is re-zeroized and recommences the counting of the signals coming from the count input. The output 217 of the counter 215 and the output 213 of the code converter 209 are connected as input to a two-bit comparator 219 adapted to compare the codes present on the outputs 217 and 213 and to supply a signal at logical level 1 on the output wire 220 when the codes are equal. The output 220 of the comparator 219 is connected to the input 210 of the counter 205.

The output 217 of the counter 215 is moreover connected as input to a decoder 225 adapted to supply a signal at logical 1 level on the output 226 when the outputs of the counter 215 are in the configuration 11. The wire 161 is also connected as input to an AND circuit 221, the other input of which is connected to the output of the decoder 225. The output 227 of the AND circuit 221 is connected to the input 211 of the counter 205.

The setting dial 194 for the number of copies is connected as input, via an AND gate 290, to a counter 233 for the number of copies still to be made. The counter 233 is decremented through count-down pulses applied via the input 249. The output 232 of the counter 233 is connected as input to a decoder 250 adapted to supply a logical 1 level on an output 251 when the counter 233 is zeroized.

The output wire **208*a* from the control and driving unit 208 of the stepping motor is connected as input to a unit 230 for controlling and driving the rotation of the cylinder 1 and the other stations of the copying machine for implementing the copying cycle. The unit 230** may be of a nature well known in the art and will therefore not be described in detail here.

There are also connected as inputs to the unit 230:

(a) the wire 231 of the printing start key 192
(b) the output 251 of the decoder 250
(c) the outputs **195*b* and 195*a* of the selector 196**.

The control unit 230 is adapted to supply the following signals as output:

(a) switching-on signal for the signal lamp 295 on wire 240
(b) a switching-on signal for the lamp 69 on wire 241
(c) a zeroizing signal on the wire 242 connected to the input 212 of the counter 205 and to a zeroizing input 271 of the counter 215
(d) an enabling signal on a wire 245 connected to the control inputs of the AND gates 204 and 290
(e) a decrementing signal for the counter 233 on a wire 249.

In the off state of the machine, the stepping motor and, consequently, the hollow cylinder 60 are in the position identified by the address 00000, in accordance with Table 2, the counters 205 and 215 are zeroized and the cylinder 1 is in the position of FIG. 1 and thus also the disc 150 is obviously in the position of FIG. 5.

Moreover, as shown in FIG. 1 and as already stated, it is assumed that the cassettes 47 inserted in the machine and positioned on the cassette supports 56 and 57 are respectively the cassette corresponding to the format Statement and the cassette corresponding to the format UNI A4.

On the switching-on of the machine by means of the key 191, the circuit of FIG. 7 is energised. The code 111 is present on the input channel 197, while the code 001 is present on the channel 197*a* (see Table 1).

Assuming that the selector is in position I, so that the cassette 47 on the support 56 is selected, then the code 111 is present on the output 199 of the multiplexer 198, as a result of which the driving circuit 208 commands the visual display 193 so that the symbol ST relating to the Statement format is visually displayed on the console 190 (as in FIG. 6).

If the operator wishes to make sure of the format present in the machine in the cassette on the support 57, he will have to move the selector into its second position; in consequence thereof, the code 001 will be output by the multiplexer and the visual display 193 will be driven to show the symbol A4.

Assuming that the operator desires to work with the copy sheet format A4, after positioning the selector in its second position he will have to set by means of the setting dial 194 the number of copies that he intends to make; the number set is stored in the counter 233. Almost certainly, but not necessarily, if the operator has chosen the format A4 for the copy sheets, he wishes to photocopy an original of the same format and, assuming that this is the case, the operator will position the original sheet of the format A4 on the illuminating surface 34 as indicated in FIG. 6 and as previously explained.

At this point, the operator can start off the carrying out of the printing of copies of the said original by means of the key 192. By pressing the key 192, a signal is sent on the wire 231 to the control unit 230 which, in known manner, executes the following preliminary operations:

(a) on the basis of the code 001 present on the output 199 of the multiplexer, it enables the sheet feed device 48, disabling the similar device 49 at the same time;

(b) it sends on the wire 240 a signal which lights the lamp 295 signalling the working state of the machine;

(c) it sends an enabling signal to the AND gates 204 and 290, whereby the code 10000 present on the output of the code converter 200 (see Table 2) is stored in the counter 205 and the number of copies which has been set is stored in the counter 233.

At this point, since the counter 205 contains the address of a position to be reached which is different from that in which the stepping motor 73 and, therefore, the hollow cylinder 60 are currently disposed, the control and driving unit 208 advances the stepping motor by sixteen steps (10000 in binary), so as to position the lateral portions only of the slot 66 corresponding to the format A4 in front of the slot 80 (as indicated in FIG. 4). When this operation has been effected, the control unit 208 sends a signal at logical 1 level on the wire 208*a* as input to the control unit 230, which in consequence thereof sees to the lighting of the lamp 69 and to the starting of the copying cycle, setting the drum 1 in rotation in the direction indicated by the arrow in FIGS. 1 and 5 and activating in the proper time sequence all the stations previously described and typical of the electrophotographic copying process.

Therefore, the result will be obtained that the photoconductive belt 8 will be charged throughout its width and total length in the charging unit 17, starting from its front edge (that close to the slot 12); it will then be exposed to the image of the original in the exposure station 18 where, however, it will be discharged in image configuration only over a central portion of a width equal to 297 mm, corresponding to the longitudinal dimension of the original format A4, and over a portion of a length equal to 210 mm, that is equal to the transverse dimension of the format A4.

As the rotation of the drum continues, the photoconductive belt 8 enters the discharging station 55 where, because of the light outlined through the slots 66 and 80, the lateral or marginal portions of the photoconductive belt 8, which are at a distance of more than 148.5 mm from the median section of the belt, are discharged, that is in practice all the lateral portion of the belt not discharged in image configuration in the station 18.

When, starting from the front edge of the belt 8, a length of belt = 210 mm (that is, equal to the transverse dimension of the format A4) has passed in front of the slot 80, the notch 151 is then detected by the reading device 160, which sends on the wire 161 a pulse at logical 1 level which is counted by the counter 215, whereby the code present on the output 217 passes from the configuration 00 to the configuration 01; since the code which is output by the code converter 209 is also 01 (see Table 3), then the comparator will supply as output a signal at logical 1 level which produces the incrementing by one binary unit of the counter 205, the output 207 of which passes in this way to the configuration 10001 and thus produces the advance of the stepping motor by one step by the unit 208 in the direction indicated by the arrow in FIG. 1 and, therefore, the positioning in front of the slot 80 of the part of the slot 66 corresponding to the format A4 which extends over the entire width of the belt 8, whereby the remaining length of the photoconductive belt 8 as far as its rear edge (the edge adjacent the slot 11 of FIG. 1) will be discharged over its entire width.

As the rotation of the cylinder continues from the point at which the notch 151 passes in front of the reading device 160, another two notches are detected by the said device and counted by the counter 215, the output of which, after the passage of the notch 153, therefore presents the code configuration 11, whereby the output 226 of the decoder is at logical 1 level and when the notch 154 is detected by the reading device 160 the count pulse at logical 1 level on the wire 161 moreover causes, on the passage of the outputs of the counter to the configuration 00, the sending of the pulse via the AND circuit 221 to the input 211 of the counter 205, the outputs of which again acquire a configuration in the code 10000 which causes the advance of the stepping motor by one step in the direction opposite to that of FIG. 1, whereby the marginal portions of the slot 66 corresponding to the format A4 are again positioned in front of the slot 80. Moreover, when the notch 154 is detected, the cylinder 1 has performed half a revolution and the front edge of the belt 8 is already under the action of the developing unit 20, which will deposit the particles of colour only in the black image areas, all the other parts of the photoconductor being discharged both by exposure to the image in the station 18 and by the discharging device 55.

As the rotation of the drum continues, while the photoconductor 8 enters the transfer station 25, where the image is transferred to the copy sheet fed by means of the device 48 from the A4 cassette 47, the photoconductive belt 7 undergoes the same treatments hereinbefore described for the belt 7. The sole difference is that in this case to increment the counter 215 there are the notches 151*a*, 152*a*, 153*a* and 154*a*.

At the end of a complete revolution of the drum, a copy sheet bearing the finished A4 image of the original is already supplied at the exit 53, while the second copy sheet is fed to the transfer station 25 and the second copy will be delivered at the exit 53 in the next 180° of rotation of the drum.

At each finished copy of the original, the counter 233 for the number of copies is decremented by one unit by the unit 230. The operations continue in the manner described until such time as the counter 233 is zeroized and, at this point, as is easy to understand, there will have been effected N + 1/2 revolutions of the drum if N was the number of copies entered in the counter 233 by means of the setting dial 194.

The zeroizing of the counter 233 puts the output 251 of the decoder 250 at logical 1 level. In response to this signal, the control unit 230 deactivates the various units 17, 35, 20, 50, 48, 30, 52, 25, 27, arrests the drum 1 in the starting position and sends a zeroizing signal to the counters 215 and 205.

More particularly, the configuration 00000 on the output 207 of the counter 205 produces on the part of the control unit 208 the movement of the stepping motor 73 and of the cylinder 60 towards the reference position. When this position is reached, the signal at logical 1 level on the wire 210 is sensed by the control unit 230, which extinguishes the lamps 69 and 295 and prearranges itself to wait for the setting of a new copying cycle.

It will therefore be understood how in general the device 55 provides for the discharge of the marginal portions of the photoconductive belt 7 or 8 which exceed the longitudinal dimension of the format over a length of belt equal to the lateral or transverse dimension of the copy sheet, which dimension is signalled in accordance with the format set by the notches 151, 151*a*, 152, 152*a* and 153, 153*a* of the disc 160, while the said device provides for the discharge of the entire width of the photoconductor over the whole of the portion of the belt which exceeds in length the said lateral dimension.

Of course, modifications may be made in the device without thereby departing from the scope of the invention. For example, the cylinder 60 could be of material transparent to light and the slots 66 could be obtained on this cylinder by blackening suitable parts of its cylindrical surface, for example by depositing a light-absorbing material on the said surface in a form complementary to the form of the slot 66 by a silk screen printing method.

What we claim is:

1. In an electrophotographic copying machine having a moving photoconductive surface adapted to be charged and to carry an electrostatic latent image thereon, developing means positioned at a developing zone to develop the moving electrostatic image on the surface, the developed image being adapted for transfer to a copy sheet having a format selected from among at least two different copy sheet formats usable in the machine, and selecting means for selecting the copy sheet format to be used, a discharge device positioned immediately before the developing zone, and adapted, when activated, to discharge a side edge portion of the photoconductive surface during a first mode of operation, and during a second mode of operation to discharge a trailed edge portion of the photoconductive surface, the dimensions of said edge portion being dependent upon the copy sheet format selected, means for detecting the position of the photoconductive surface during its motion, and control means responsive to the selecting means and to the detecting means for activating the discharge device in the first mode of operation during a first part of said motion, depending on the selected format, and for switching the discharge device to the second mode of operation during the remaining part of the motion.

2. In an electrophotographic copying machine wherein a photoconductive element is cyclically moved through a station for charging its surface electrostatically, a station for exposing its surface to the light image of the original to be copied and a station for developing the image to be transferred to a copy sheet of a format selected from a plurality of formats usable in the machine, a device disposed adjacent to the path of movement of the photoconductive element between the exposure station and the developing station for discharging that portion of the area of the photoconductive element which exceeds the area of the copy sheet, comprising:

a lamp, mask means disposed between the lamp and the photoconductive element, the mask means having a plurality of slots being shaped to include, a first portion for directing the light of the lamp perpendicular to the movement of the element so as to illuminate the marginal part of the photoconductive element which exceeds dimensions of the associated copy sheet format, and a second portion adjacent to the first portion, the second portion directing the light of the lamp so as to illuminate the whole dimension of the photoconductive element along a direction perpendicular to the movement of the element, means for positioning the first portion of the slot associated with the selected format between the lamp and the photoconductive element during the passage adjacent to the lamp of a part of the photoconductive element equal to the other dimension of the selected copy sheet format and for positioning the second portion of the slot associated with the selected format between the lamp and the photoconductive element during the passage adjacent to the lamp of the remaining part of the photoconductive element.

3. In a copying machine according to claim 2 wherein the mask means comprises an opaque hollow cylinder mounted with its generatrices perpendicular to said movement and in the cylindrical surface of which the slots are formed parallel to the generatrices, the lamp being mounted inside the hollow cylinder.

4. In a copying machine according to claim 3, wherein the positioning means comprise a stepping motor for rotating the hollow cylinder.

5. An electrophotographic copying machine, comprising:

a photoconductive plate means for moving the photoconductive plate cyclically along a predetermined closed path a plurality of processing stations disposed adjacent said path including charging, exposure, developing and transfer stations first and second copy sheet storage units, each unit storing copy sheets of a format selectable among a plurality of formats processable by the machine first and second actuatable single sheet feeding device for feeding a copy sheet from said first and respectively second unit to the transfer station in synchronism with the movement of the plate along said path a discharge device positioned adjacent said path between the exposure station and the developing station for discharging unused portion of the plate having:

a lamp and positionable mask means interposed between the lamp and the plate including:

a plurality of slots each having a first portion being associated with a particular copy sheet format for restricting the area illuminated by said lamp to a side portion of the plate in a direction perpendicular to its movement along said path, said side portion having an extension along the said direction equal to the difference between the dimension of the plate along the said direction and the corresponding dimension of the copy sheet format associated with each first slot and at least a second portion of said slot extending over the whole dimension of the plate parallel to said direction for outlining the light to illuminate the whole of said dimension of the plate first sensing means for sensing the format of the copy sheet stored in each of said storage units selecting means for selecting one of said storage units means responsive to said selecting means for enabling the feeding device associated to the selected storage unit second means for sensing the position of the plate along said path during its movement means responsive to said selecting means and said first and second sensing means for positioning said mask means with said first portion of said slot corresponding to the selected format in front of the lamp during a first part of the plate movement along said path during which a length of photoconductive plate at least equal to the second dimension of the copy sheet format selected is passed in front of the discharging device, and for positioning said mask means with said second portion of said slot in front of the lamp for the remaining part of the plate movement.

* * * * *

UNITED STATES PATENT AND TRADEMARK OFFICE

CERTIFICATE OF CORRECTION

PATENT NO. : 4,129,378

DATED : December 12, 1978

INVENTOR(S) : Luciano Rattin et al.

It is certified that error appears in the above-identified patent and that said Letters Patent are hereby corrected as shown below:

Column 11, line 15, "N + 1/2" should be

-- $\frac{N + 1}{2}$ --.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*